United States Patent [19]

Jannier et al.

[11] 4,090,929

[45] May 23, 1978

[54] RAPID CHROMIC ACID ANODIZATION

[75] Inventors: Michel Jannier, Paris; Florent Berlo, Levallois Perret; Jean Bridier, Paris, all of France

[73] Assignee: Pechiney Ugine Kuhlmann, Lyon, France

[21] Appl. No.: 798,834

[22] Filed: May 20, 1977

[30] Foreign Application Priority Data

Jun. 4, 1976 France ..... 76 18166

[51] Int. Cl.[2] ..... C25D 7/06; C25D 11/06

[52] U.S. Cl. ..... 204/28; 204/58

[58] Field of Search ..... 204/28, 58

[56] References Cited

U.S. PATENT DOCUMENTS 3,865,700 2/1975 Fromson ..... 204/28

*Primary Examiner*—R. L. Andrews

*Attorney, Agent, or Firm*—McDougall, Hersh & Scott

[57] ABSTRACT

The process which is the object of the invention concerns the surface treatment of aluminum alloys by anodization. It consists of treating the aluminum alloy objects to be coated by making them the anode in a bath through which a direct current passes, under the following operating conditions:

— chromic acid bath of a concentration of 100 to 200 g/liter

— temperature of 55° to 70° C

— current density of 3.5 to 5 amperes/dm$^2$

— cathode surface area less than 0.06 times the volume, in liters, of the bath

— anode surface of 1.7 to 2.3 times the volume, in liters, of the bath. Under these conditions a high oxide layer growth rate is obtained, namely 1 micron per minute. The process can be used in particular in the anodization of continuous strips.

6 Claims, No Drawings

RAPID CHROMIC ACID ANODIZATION

This invention relates to the anodization of aluminum and alloys of aluminum, preferably in the form of continuous strips, to form an oxide layer thereon.

The protection of the surface of aluminum-based products by forming an aluminum oxide surface layer obtained by immersing the product in an electrolytic bath through which a continuous current flows, and in which the anode consists of said product, has been known for many years.

The first baths used were solutions of chromic acid, initially of low concentration, for example 2.5 to 3.5% by weight. Sulphuric acid baths then appeared and have to some extent more or less replaced chromic acid baths, particularly on account of the high price of chromic acid and pollution problems connected with the toxicity of hexavalent chromium. In fact, during operation, there is on the one hand a decrease in hexavalent chromium, which is converted into trivalent chromium salts, and on the other hand an increase in aluminum salts. Chromic acid has to be added periodically to the bath when, after analysis, it is found that the amount of hexavalent chromium has become too low; this however does not remove the trivalent chromium and aluminum salts which have been formed, and after a certain time, the bath has to be discarded or regenerated. It is relatively easy to free the bath of $Al+++$ ions by passing the bath in contact with cation exchange resins which fix the dissolved aluminum salts, but the regeneration of trivalent chromium ions into hexavalent chromium ions is much more complicated and costly.

Chromic acid anodization is nevertheless of interest compared with sulphuric acid anodization on account of a certain number of important advantages:

- the anodized layer is opaque, from a certain thickness of the order of 4 to 5 microns.
- at the same thickness and by virtue of, in particular, the presence of chromium salts in the oxide layer, which act as inhibitors, the said layer has a better corrosion resistence.
- on account of its low thickness and suitable mechanical properties, the layer is more flexible and is better able to withstand deformation. Anodized sheets may, for example, be stamped or pressed without any danger of rupturing the protective layer. Furthermore, the wear resistance of pieces and articles is not substantially affected, in contrast to the wear resistance of pieces which have undergone sulphuric acid anodization.
- the layer has a better resistance to increases in temperature.

These particular qualities mean that chromic acid anodization is extensively used, for example, in the aircraft industry where the qualities of good corrosion resistance and the absence of any deterioration in fatigue and wear characteristics are highly valued.

French Pat. No. 1,399,797 represents a definite advance in anodization processes since it provides operating conditions which enable the concentration of trivalent chromium to be limited to a constant value, this concentration as well as that of hexavalent chromium varying no longer during the anodization. This means in effect that, during the course of the successive anodization operations, there is no longer any reduction of hexavalent chromium ions into trivalent chromium ions: during the first operation, the ratio of the concentrations of hexavalent chromium to trivalent chromium is established at an equilibrium value which does not vary substantially during the following operations. The only "wear" on the bath is produced by its enrichment with aluminum salts and the only regeneration operation which has to be carried out is the removal of these aluminum salts by a cation exchange resin.

In order to achieve this result, the aforementioned patent specifies the following measures:

- cathode surface as small as possible, i.e. less than 0.06 B $dm^2$ and preferably between 0.03 B and 0.05 B $dm^2$, B being the volume of the bath in liters
- anode surface between 1.7 B $dm^2$ and 2.3 B $dm^2$
- electrolysis voltage below 25 volts and preferably between 21 and 23 volts
- chromic acid concentration between 15 and 19% by weight
- temperature of the bath less than 30° C.

This process is however fairly long, and it takes 90 minutes to obtain an oxide layer having a thickness of 4.5 microns, i.e. a layer growth rate of 1 micron per 20 minutes. The other chromic acid anodization processes under constant voltage are furthermore only slightly faster, namely about 1.5 microns in 20 minutes.

Three of the properties of chromic acid anodic coatings, which make them particularly suitable for producing anodized strips for the production of electrical household appliances, for example, are their ability to be stamped or pressed, their good resistance to increase in temperature, and the fact that they can be colored.

However, the length of the anodization operation constitutes a drawback for the continuous anodization of strips. In fact, on account of the lack of a sufficiently rapid process, it would either be necessary to employ very slow speeds through the bath or to use baths of impracticable size.

It is an object of this invention to provide a much more rapid growth rate of the oxide layer, of the order of 1 micron per minute, while preserving on the one hand the good qualities of the oxide layer, namely opacity, ability to be colored, and flexibility, and on the other hand the good stability properties of the anodization bath.

By operating in the manner described hereinafter, a layer growth rate is obtained which has not been achieved in any of the aforementioned processes, since it can be as high as 1 micron per minute.

Such a layer growth rate is particularly valuable since it then justifies the treatment of products such as continuous strips. The residence time in the bath necessary to obtain a layer 5 microns thick, which is considered to be very satisfactory in practice, is in fact of the order of 5 minutes and does not in any way exceed 10 minutes. However, it is also possible to obtain substantially thicker layers, for example of the order of 10 microns.

The operating conditions in accordance with the invention are as follows: first of all, as in French patent specification No. 1,399,797, the current should be a direct current. As in the patent, it is also convenient to adhere to certain ratios between the volume of the bath, the cathode surface, and anode surface.

The total surface of the cathodes should be $< 0.06$ B and preferably between 0.03 B and 0.05 $dm^2$, B being the volume of the bath expressed in liters, while the anode surface should be between 1.7 B and 2.3 B $dm^2$, the ratio of the anode/cathode surfaces thus being between 76.7 and 28.4.

The other operating conditions, although they depart more or less substantially from the conditions in the French Pat. No. 1,399,797, nevertheless together constitute a narrow range in which the same advantages as those of the patent are substantially combined with the addition of a much higher anodization rate. The concentration, calculated as $CrO_3$, should be between 100 and 200 grams per liter of bath and preferably approximately 150 g/liter.

The temperature is much higher and should preferably be between 58° and 62° C. It is possible however to operate at 55° C to 70° C, but the quality of the coating and the growth rate decrease as soon as the temperature departs from the optimum value of 60° ± 2° C.

The current density should preferably be between 3.5 to 5 amperes per $dm^2$, and may be as high as 10 $A/dm^2$ in a continuous process.

The constant voltage applied, after a peak which may be as high as 75 volts at the start of the anodization, is then stabilized to a value between 35 and 45 volts.

It has been found that this set of conditions enables oxide layers of suitable quality to be obtained at a growth rate of approximately 1 micron/minute without any noticeable deterioration in the bath by continuous enrichment of $Cr+++$ ions. However, it has also been found, without being able to provide a scientific explanation, that these results were even improved at once, as regards the quality of the oxide layer and the stability of the bath, when aluminum cathodes are used, which have been found to be far better than for example graphite or lead-antimony cathodes, which may also be used for this purpose.

The operation of this process, such as has just been described, is general and can be applied equally well in both the static and continuous processes. However, as has been mentioned above, the rapid increase in the oxide layer makes the process particularly suitable for the continuous anodization of products such as strips, bands or wires.

As an example, an A5 strip 100 mm wide and 0.3 mm thick was anodized under the following conditions, which are given purely by way of illustrating the invention and not by way of limitation:

The continuous anodization line comprises in succession:

— a degreasing bath tank
— a tap water rinsing tank
— an anodization tank with liquid current input filled with a solution of chromic acid present in a concentration of 180 g/liter. The operating length of this tank is 3.5 meters.
— a distilled water rinsing tank
— a rinsing compartment using a jet of tap water The electrodes are of lead-antimony, but better results may furthermore be obtained with aluminum electrodes.

The process is carried out using direct current under a constant voltage of 42 volts. The temperature of the bath is maintained at 60° - 65° C. Under these conditions, an anode current density of about 7 amps./$dm^2$ is observed. The velocity of the strip is adjusted to 0.7 meters/minute, corresponding to a residence time in the anodization tank of $$3.50 \text{ meters}/0.70 \text{ m/minute} = 5 \text{ minutes.}$$

At the outlet to the line, it is found that the strip is covered with an opaque oxide layer the thickness of which, when measured after sealing, is 5 microns. This layer may then be colored by conventional chemical or electrolytic coloring processes.

It will be understood that changes may be made in the details of formulation and operation, without departing from the spirit of the invention, especially as defined in the following claims.

We claim:

1. Process for anodization of aluminum and alloys of aluminum comprising mounting the product to be anodized as the anode in an anodizing bath containing 100 to 200 g/liter of $CrO_3$, with an anode surface area expressed in $dm^2$ of between 1.7 B and 2.3 B where B denotes the volume of the bath in liters, with a cathode surface area expressed in $dm^2$ of less than 0.06 B. maintaining the temperature of the anodization bath at a temperature between 55° C and 70° C, and applying a constant voltage between the electrodes between 35 volts and 45 volts, and an anode current density between 3.5 $A/dm^2$ and 5 $A/dm^2$.

2. The process as claimed in claim 1, in which the cathode surface area is within the range of 0.03 B–0.05 B.

3. The process as claimed in claim 1, in which the temperature of the bath is between 58° C and 62° C.

4. The process as claimed in claim 1, in which the cathode surfaces are of aluminum or aluminum alloys.

5. The process as claimed in claim 1, in which the product continuously passes through the anodization bath and the anode current density is between 3.5 $A/dm_2$ and 10 $A/dm^2$.

6. The process as claimed in claim 1, in which the product to be anodized is in the form of strips, bands, threads or wire and in which the product is passed continuously through the bath in a continuous operation.

* * * * *